US006481571B1

(12) United States Patent
Kelders et al.

(10) Patent No.: US 6,481,571 B1
(45) **Date of Patent: *Nov. 19, 2002**

(54) DUAL-COMPONENT CONTAINER SYSTEM

(75) Inventors: Johannes Hubertus Jozef Maria Kelders, Drunen; Roy van Swieten, Oud-Heusden, both of (NL)

(73) Assignee: R & D Injector, AG, Baar (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/423,945

(22) PCT Filed: May 12, 1998

(86) PCT No.: PCT/CH98/00195

§ 371 (c)(1),
(2), (4) Date: Feb. 23, 2000

(87) PCT Pub. No.: WO98/51586

PCT Pub. Date: Nov. 19, 1998

(51) Int. Cl.[7] ..... B65D 25/08
(52) U.S. Cl. ..... 206/219; 206/221
(58) Field of Search ..... 206/219, 221, 206/222, 568; 215/DIG. 8

(56) References Cited

U.S. PATENT DOCUMENTS

| | | | | | |
|---|---|---|---|---|---|
| 3,410,444 | A | | 11/1968 | Morane | 220/20 |
| 5,647,481 | A | * | 7/1997 | Hundertmark et al. | 206/219 |
| 5,908,107 | A | * | 6/1999 | Baudin | 206/221 |
| 5,992,693 | A | * | 11/1999 | Albisetti | 206/221 |
| 6,047,818 | A | * | 4/2000 | Warby et al. | 206/219 |

FOREIGN PATENT DOCUMENTS

| | | | |
|---|---|---|---|
| DE | 4436863 | 1/1996 | B65D/81/32 |
| DE | 297 21 872 | 3/1998 | B65D/81/32 |

* cited by examiner

*Primary Examiner*—David T. Fidei
(74) *Attorney, Agent, or Firm*—Ann W. Speckman; James E. Klaniecki

(57) ABSTRACT

Dual component container systems are provided for separately storing at least two liquids, which are intermixed within the system prior to dispensing. Two or more containers having mixing openings are provided wherein the mixing openings are sealed by sealing members. The sealed openings of the containers are interconnected by one or more connecting elements, thereby forming a sealed conduit interposed between containers and wherein at least one of the sealing members is connected to the connecting element by a releasable clamping joint. Systems of the present invention are designed such that relative movement of the two containers causes the sealing members to open or be removed, whereby fluids from the two or more containers may intermix via the open conduit formed by the connecting element.

14 Claims, 8 Drawing Sheets

DUAL-COMPONENT CONTAINER SYSTEM

BACKGROUND OF THE INVENTION

The present invention relates to a container system comprising at least two containers for keeping substances separate which are to be used as a mixture in which arrangement the containers each have a mixing opening which can be sealed by means of a sealing cap and are interconnected by means of a connecting element interacting with the sealing caps the mixing openings facing each other.

A double chamber system e.g. is known in the chambers of which the components of two-component substances are stored and sealed separately. Before use the seals are to be opened destructively e.g. by cutting or piercing in order to combine the substances. From the patent DE-C-44 36 863 a double chamber system of this type is known in which the containers are sealed by stops which can be clamped tight and which if moved relative to each other mutually push out each other from their clamping seal position in such a manner that connecting ducts between the containers are laid open. In this arrangement the container openings, however, are restrained very much and the substances to be mixed are hampered in their flow by the construction elements to which they tend to cling.

Furthermore a container system of this type is described in the German patent application 19635833 not laid open by the applicant for the present invention.

The container system described therein, serving for storing a two component hair dye, consists of a cylindrical lower container and of a spherical upper container. The lower container on its upper side, and the upper container on its lower side respectively, each are provided with a mixing opening. Both mixing openings are sealed by a screw-on cap each in which arrangement the screw-on cap of the lower container is screwed into the neck of this container whereas the screw-on cap of the upper container is screwed into a threaded portion of a connecting ring. The upper container is screwed into an outer threaded portion of the connecting ring in such a manner that the opening of the upper container is sealed by the corresponding sealing caps as well as by the connecting ring. The lower container including the cap screwed tightly thereto is screwed with its neck into the inside threaded portion of the connecting ring. As the respective containers, the corresponding caps and the connecting ring are screwed together also a snap-on connection between the two caps is established.

Before being screwed together the two containers are filled each with a different component of the hair dye. All screw connections except the screw connection for fastening the sealing cap in the lower container are threaded in the same direction. Furthermore both screw-on caps are provided with a pin each which pins engage each other and the screw-on cap of the lower container is provided with a protruding element which can co-operate with a guide groove provided in the connecting ring.

If now the liquids contained in the two containers are to be mixed for use, first a part of the intermediate ring, which might be laid out e.g. as a tear-off strip, is taken off in such a manner that an axial movement of the two containers relative to each other becomes possible. Subsequently the lower container is rotated relative to the connecting ring and the upper container in which process its cap owing to the opposite thread direction in the cap also will be rotated. The pins in this screw-on cap and the pins in the cap of the upper container in this process engage in such a manner that also this cap is rotated and thus is screwed out of the connecting ring.

During the rotation the protruding elements of the screw-on cap of the lower container sooner or later will engage in such a manner that the screw-on cap is secured against further rotation. As the lower container is rotated further relative to the intermediate ring its screw-on cap now is blocked and owing to the opposite thread direction of the thread in the cap is unscrewed from the neck of the lower container. In this manner finally the screw-on cap of the lower container and the screw-on cap of the upper container connected thereto are unscrewed from the respective openings in such a manner that between the lower and the upper containers an open passage is established for the liquids. The components contained in the respective containers thus can be mixed if the container system is shaken in which arrangement the two caps form a shaker element. Subsequently the two component liquid thus created can flow out of an opening which had been sealed be a sealing cap which was screwed on and can be used.

Compared to other containers for two component liquids in which the elements are to be cut open or to be pierced this container system shows the advantage that between the two containers a large opening is created for the liquids as the two sealing caps are unscrewed. Furthermore the system after use in principle can be re-filled and can be re-used.

SUMMARY OF THE INVENTION

The container system described above presents the disadvantage, however, that manufacture and assembly of the system is relatively complicated and cost intensive due to the multiple application of threaded connections whereas the assembly must be effected with great care in order to ensure that the sealing cap of the upper container is unscrewed completely during the rotational movement of the lower container. Furthermore the tear-off strip which determines the positions of the two containers relative to each other can not be re-used once the system has been opened. Thus the connecting ring as a whole must be replaced for re-filling.

It thus is the objective of the present invention to improve a container system of the type described above in such a manner that its elements can be manufactured and assembled in simpler and less expensive manner. According to the present invention this objective is met using an arrangement in which at least one of the sealing caps is connected to the connecting element with the help of a clamping connection. As the sealing cap is clamped onto the connecting element both the sealing cap and the connecting element can be designed simpler in form and connecting the elements can be effected faster. Advantageously the sealing cap is snapped onto the connecting element in such a manner that a positive connection between the sealing cap and the connecting element is established. Advantageously at least one of the holders is connected almost immovably in axial direction to the connecting element. Thus no axial movement between the two containers is required any more in order to release the caps and thus no more tear-off strip is required and the connecting element as a whole thus can be re-used. Advantageously the sealing caps and the container can be fastened to the connecting element using a snap-on connection which arrangement further simplifies design lay-out and assembly. In this manner a positive fastening of these elements on the connecting element is established. The other sealing cap preferentially is screwed onto the corresponding container in which arrangement the connecting element is provided with means securing the screw-on cap against rotational movements. In this manner a rotation of the container is transformed into a straight axial movement of the screw-on cap. The securing means in this arrangement can comprise at least one guide rim, arranged between the two sealing caps, co-operating with the screw-on cap, which rim preferentially is designed to be self-centring in such a manner that, even if the position of the screw-on cap relative to the connecting element should not be aligned exactly, the guide rim and the screw-on cap still engage. In order to verify unambiguously the sealed starting position of the container system preferentially the container sealed by the screw-on cap in any case and the connecting element are of non-circular cross-section form. In this arrangement it can be seen at first glance whether the container had been rotated away from its initial position. In order to ensure that the screw-on cap actually is released as the corresponding container is rotated, the container and the connecting element are provided with preferentially co-operating blocking means which are effective in a given direction, e.g. in the form of engaging blocking gear wheels. In this manner the container can be rotated only in the proper direction desired relative to the connecting element. Advantageously the container sealable by the screw-on cap and the connecting element can be rotated relative to each other over at least half a turn. If the containers and the connecting element are of asymmetric cross-section it can be clearly seen in which position the container system is. In order to establish a container system which is leak-proof under all circumstances, in spite of the relatively simple connections provided between the various elements, at least one seal can be provided arranged between the containers. The sealing caps advantageously are connectable mutually to form a leak-proof connection. Together they thus form a floating body in such a manner that release of the sealing caps from the openings is facilitated and that this body at the same time serves as a shaking element for better blending the respective liquids.

For using the combined component liquids at least one of the container can be provided with a dispenser opening which using a sealing cap clamped thereon can be sealed. If the sealing cap is just clamped onto the dispenser opening the design of the container system is simplified further.

BRIEF DESCRIPTION OF THE DRAWINGS

The present invention is described in more detail in the following with reference to a design example illustrated in the drawings. It is shown in the.

In the Figures the elements shown identically are referred to using the same reference numbers unless stated otherwise.

DETAILED DESCRIPTION OF THE INVENTION

Figure 1:
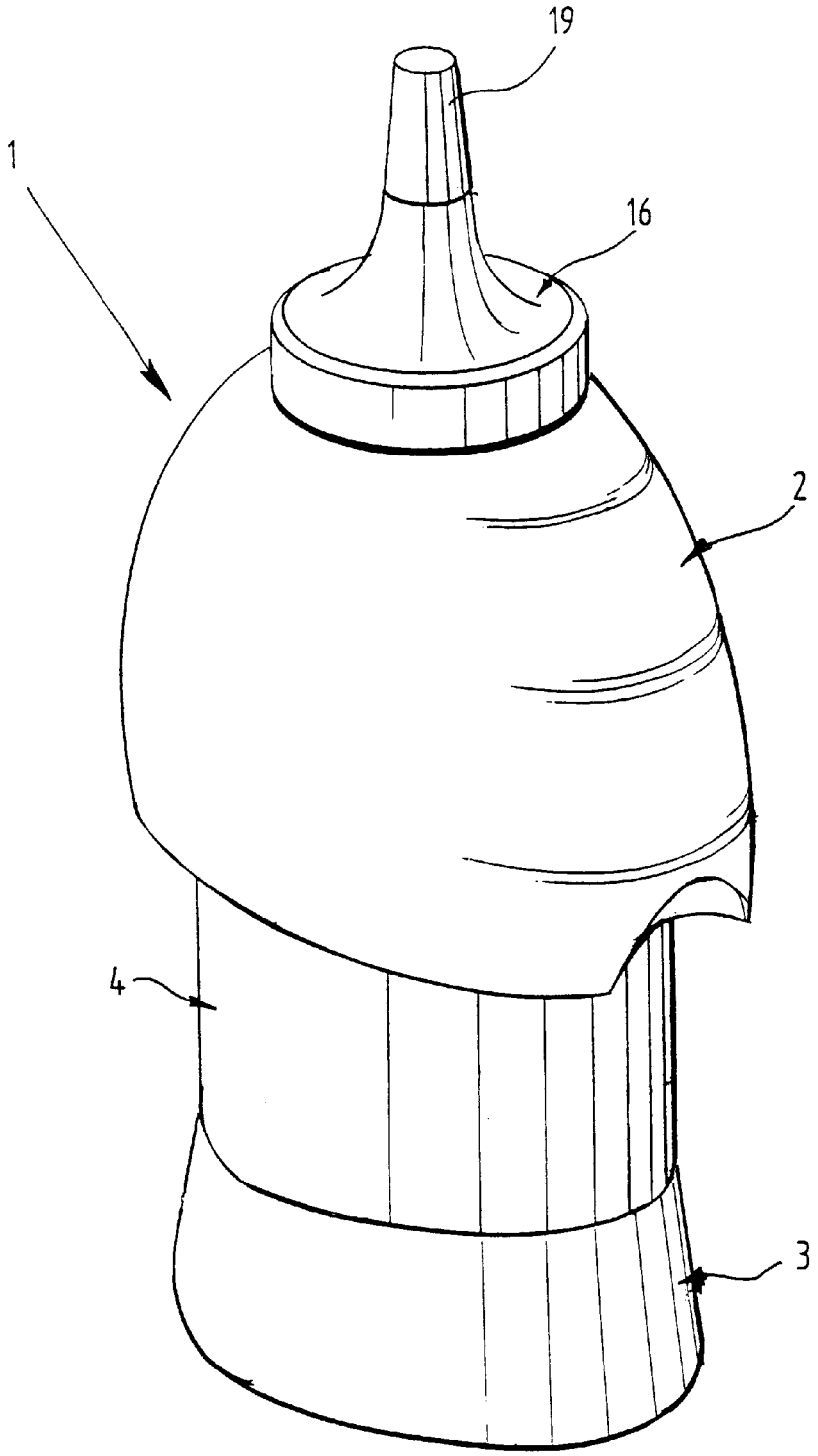
FIG. 1 an axonometric view of an inventive container system before use.

A container system 1 according to the present invention consists of an upper container 2 and of a lower container 3 which containers are interconnected via a connecting element 4 (FIG. 1). As can be seen from the FIG. 1 the upper container 2, the connecting element 4 and the lower container are of a non-circular, in particular of an elliptic, cross-section. The containers 2, 3 can contain different substances, in particular liquids, which are to be stored separately but are to be mixed before use, e.g. the components of a two component liquid. The containers 2, 3 each are provided with a mixing opening 5, 7 which in the mounted state of the system face each other. The openings 5, 7 each are sealed using a sealing cap 6, 8 in which arrangement the sealing cap 8 is screwed onto the neck of the lower container 3, whereas the sealing cap 6 is connected to the connecting element 4 using a snap-on connection 9 and to which connecting element the upper container 2 is connected using a screw-on connection 10. The opening 5 of the container 2 thus is sealed by the connecting element 4 as well as by the sealing cap 6. In order to ensure proper sealing the sealing cap is provided with a circumferential groove 38 into which the bevelled end portion 28 of a cylindrical portion 23 of the connecting element 4 is inserted. Furthermore the connecting element 4 is provided with a circumferential sealing rib 27 which together with the cylindrical threaded part 26 of the connecting element 4 forms a groove 39 into which a bevelled end portion of the upper container 2 is inserted. Correspondingly the sealing cap 8 is provided with a circumferential groove 33 into which a bevelled end portion of the neck 31 of the lower container 3 extends.

Figure 2:
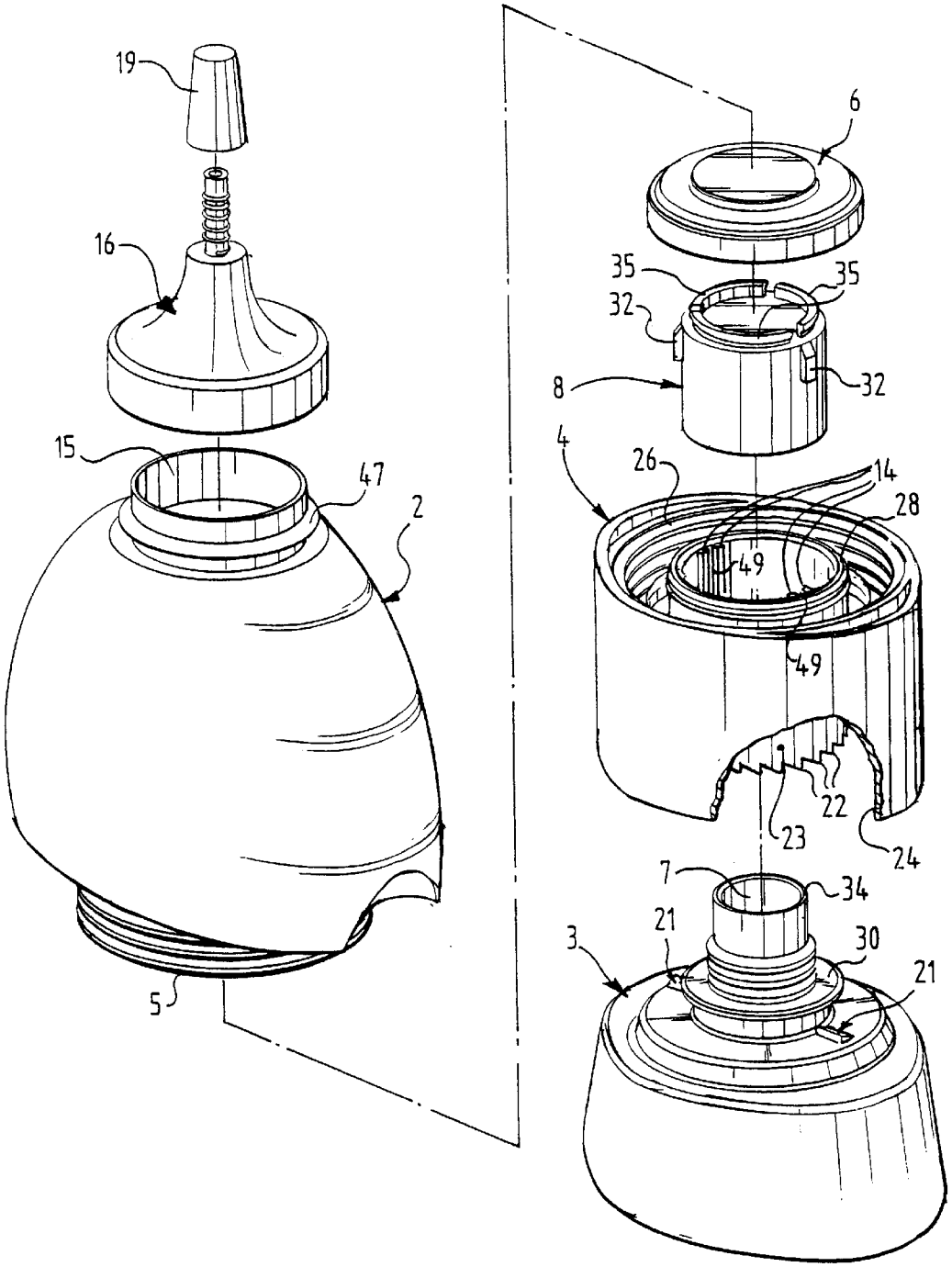
FIG. 2 an axonometric view of a first embodiment of the container system in an exploded view certain elements being omitted, FIG. 3 an axonometric view of a cross-section along a symmetry plane of the axonometric illustration of the container system according to the FIG. 2 before use, FIG. 4 an enlarged view corresponding to the view according to the FIG. 3 of the container system during the take-off of the sealing caps, FIG. 5 a view comparable to the one according to the FIG. 2 of an alternative embodiment of the container system, FIG. 6 an axonometric view of a cross-section along a symmetry plane of an axonometric view of part of the container system according to the FIG. 5 before use, FIGS. 7 and 8 top views of the lower container of the container system, and in the directions of the arrows VII and VIII according to the FIG. 5 the seal ring being omitted for better clarity of the illustration, FIG. 9 a view corresponding to the one shown in the FIG. 6 of the container system during the taking off of the sealing caps.
Figure 3:
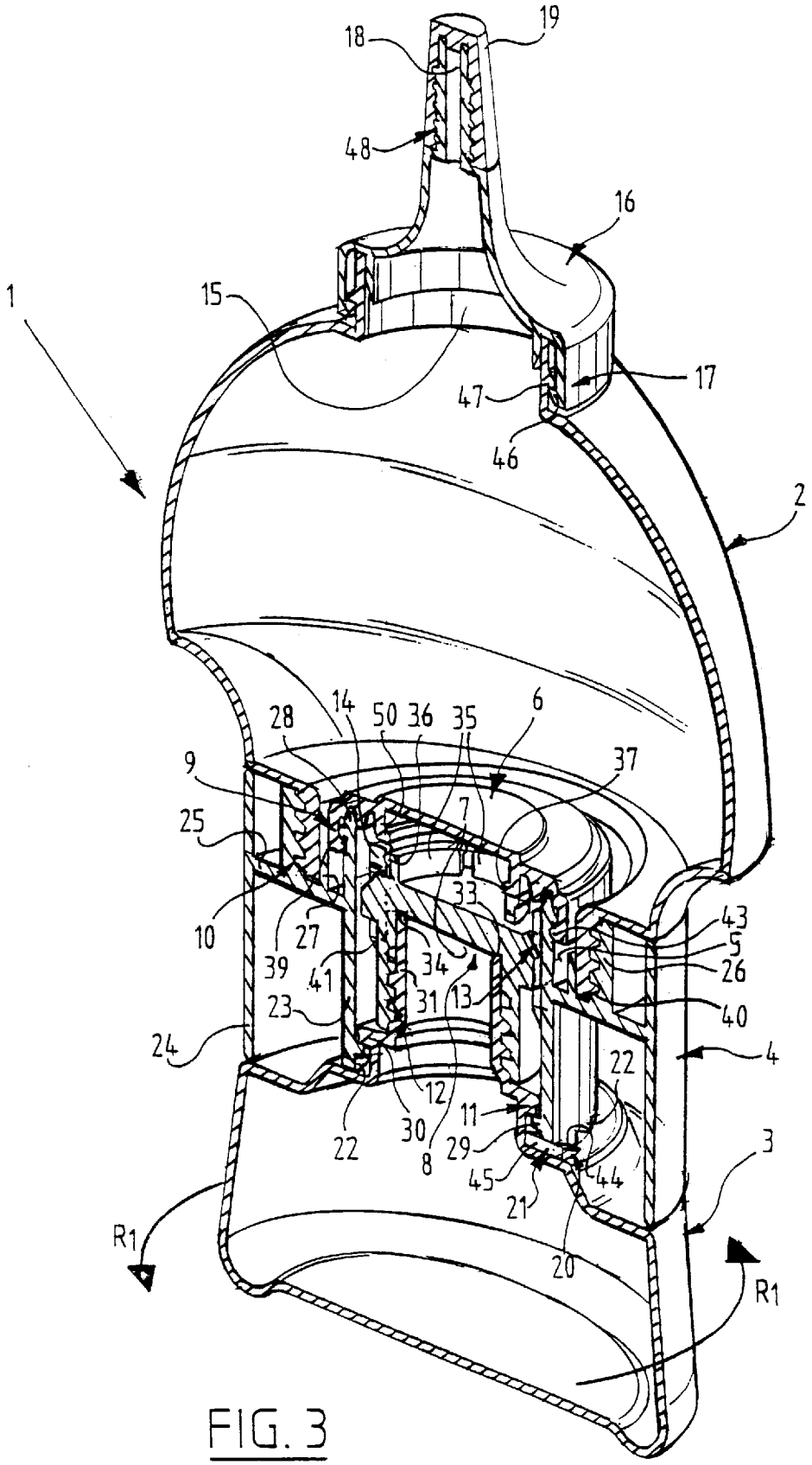

The lower container 3 is connected to the connecting element 4 (FIG. 4) using a snap-on connection 11 consisting of a circumferential rib 30 arranged on the lower container 3 and of a circumferential rib 29 on the cylindrical portion 23 of the connecting element 4. The lower container 3 and the connecting element 4 further more are provided with co-operating blocking means 20 which are effective in a determined direction of rotation consisting of two saw tooth pins 21 arranged on the lower container 3 and a large number of blocking wheel teeth 22 co-operating therewith arranged on the lower side of the cylindrical portion 23 of the connecting element 4. The saw-tooth pins 21 in this arrangement are provided with a face side 45 protruding vertically from the top face side of the container 3 and with a surface 44 inclined towards the top face side of the container 3 (FIG. 3). Furthermore the connecting element 4 is provided with means 13 securing the screwed-on sealing cap 8 against rotation. These securing means consist of four parallel guide strips 14 arranged in pairs opposed to each other along the inside wall of the cylindrical portion 23 of the connecting element 4 (compare the FIG. 2). Two guide strips 14 arranged in pairs in this arrangement each form a guide groove 49 into which a guide pin 32 of the screw-on cap 8 extends.

Figure 4:
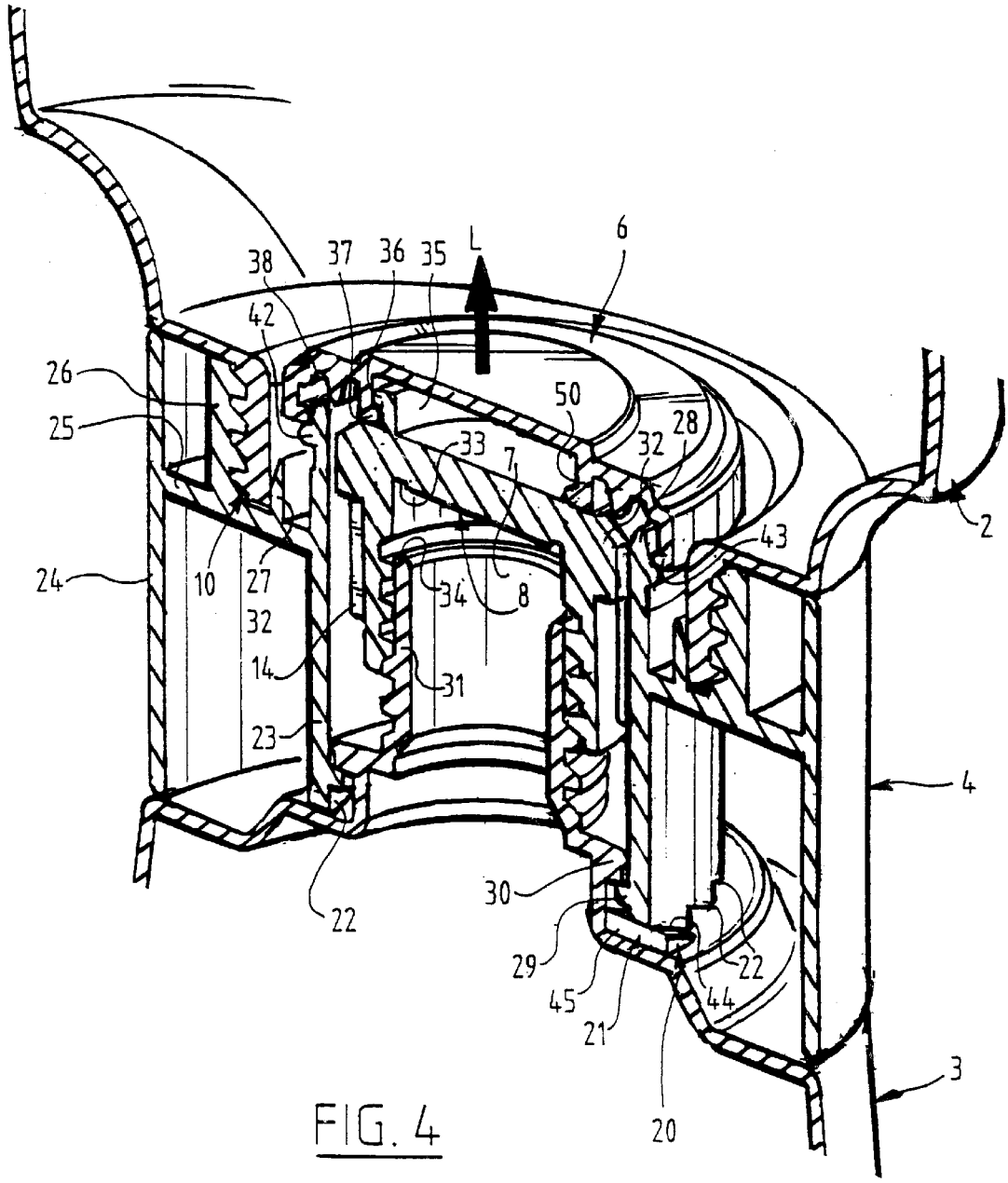

The screw-on cap 8 on its upper side furthermore is provided with a number of protruding segments 35 each presenting a snap-on rim 36 protruding outwardly (FIG. 4). Correspondingly the sealing cap 6 is provided with a circumferential flange 50 presenting a snap-on rim 37 protruding towards the inside. The protruding parts 35 being laid out as segments which do not form an uninterrupted flange they are relatively flexible and bendable in comparison to the other elements of the arrangement.

The upper container 2 on its side opposite the mixing opening 5 is provided with a dispenser opening 15 which is sealed using a sealing cap 16 fastened thereto by means of a snap-on connection 17. The sealing cap 16 in this arrangement consists of a dispenser body merging into a relatively narrow dispensing opening 18 sealed by a cap 19 mounted thereon using a screw-on connection 48. Instead of a screw-on connection of course also a snap-on connection with sealing snap-on rims in analogy to the rims 46 and 47 of the snap-on connection 17 could be used.

Before the container system 1 can be used the lower container 3 first is filled with the corresponding liquid and is sealed using the sealing screw-on cap 8. Subsequently the lower container 3 including the sealing cap 8 screwed thereon is snapped into the connecting element 4 the guide pins 32 engaging the guide grooves 49. Then the sealing cap 6 of the upper container 2 can be snapped into the connecting element 4 and the upper container 2 can be screwed into the connecting element 4 whereupon the upper container 2 can be filled via the opening 15 before this opening is sealed using the sealing cap 16. Also it is possible to first fit the sealing cap 16 to the container 2, turn the container upside down and fill it via the mixing opening 5 and subsequently screw the remaining part of the container system (i.e. the lower container 3, the connecting element 4 and the sealing cap 6 snapped onto it) in reversed position onto the container 2. In this state the two components can be stored separately in the containers 2, and 3 respectively. The non-circular, in the example described elliptic, cross-sectional shapes of the lower container and of the connecting element 4 are arranged adjacent to each other in such a manner that in just looking at the container system 1 it can be seen whether the containers 2 and 3 actually are properly sealed and ready for use.

If now the contents of the container system 1 is to be used the components stored in the containers 2 and 3 first must be mixed. For this purpose the lower container 3 is rotated relative to the connecting element 4 in the direction admitted by the blocking means 20 (arrows $R_1$; FIG. 3). In this arrangement the screw-on cap 8 can not rotate together with the lower container 3 as it is secured against rotation by the guide strips 14. The screw-on cap 8 thus is counter-rotated relative to the lower container 3 in such a manner that this cap is unscrewed from the neck 31 of the lower container 3. In this process the screw-on cap 8 moves upwards until the snap-on rims 36 of the protruding segments 35 engage the snap-on rim 37 of the upper sealing cap 6 and the flange 50 of the upper sealing cap 6 rests against the upper face side of the screw-on cap 8.

As the lower container 3 is rotated further the upper sealing cap 6 owing to the further upward movement (in the direction indicated by the arrow L in the FIG. 4) of the screw-on cap 8 is carried on in such a manner that the snap-on connection 9 between the sealing cap 6 and the connecting element 4 is disconnected. Now the screw-on cap 8 also reaches the end of the treaded part of the neck 31 in such a manner that the two sealing caps 6 and 8 are detached from the connecting element 4, and from the lower container respectively, and that between the openings 5 and 7 of the upper container 2 and the lower container 3 facing each other an open passage for the liquids is established. The components contained therein thus can be mixed and blended by shaking the container system 1 in which process the interconnected sealing caps 6 and 8 floating in the liquid in the upper container 2 act as a shaking element. The blended two component liquid finally, after the cap 19, or even the sealing cap 16 respectively, is taken off, can flow out the dispenser opening 15.

Figure 5:
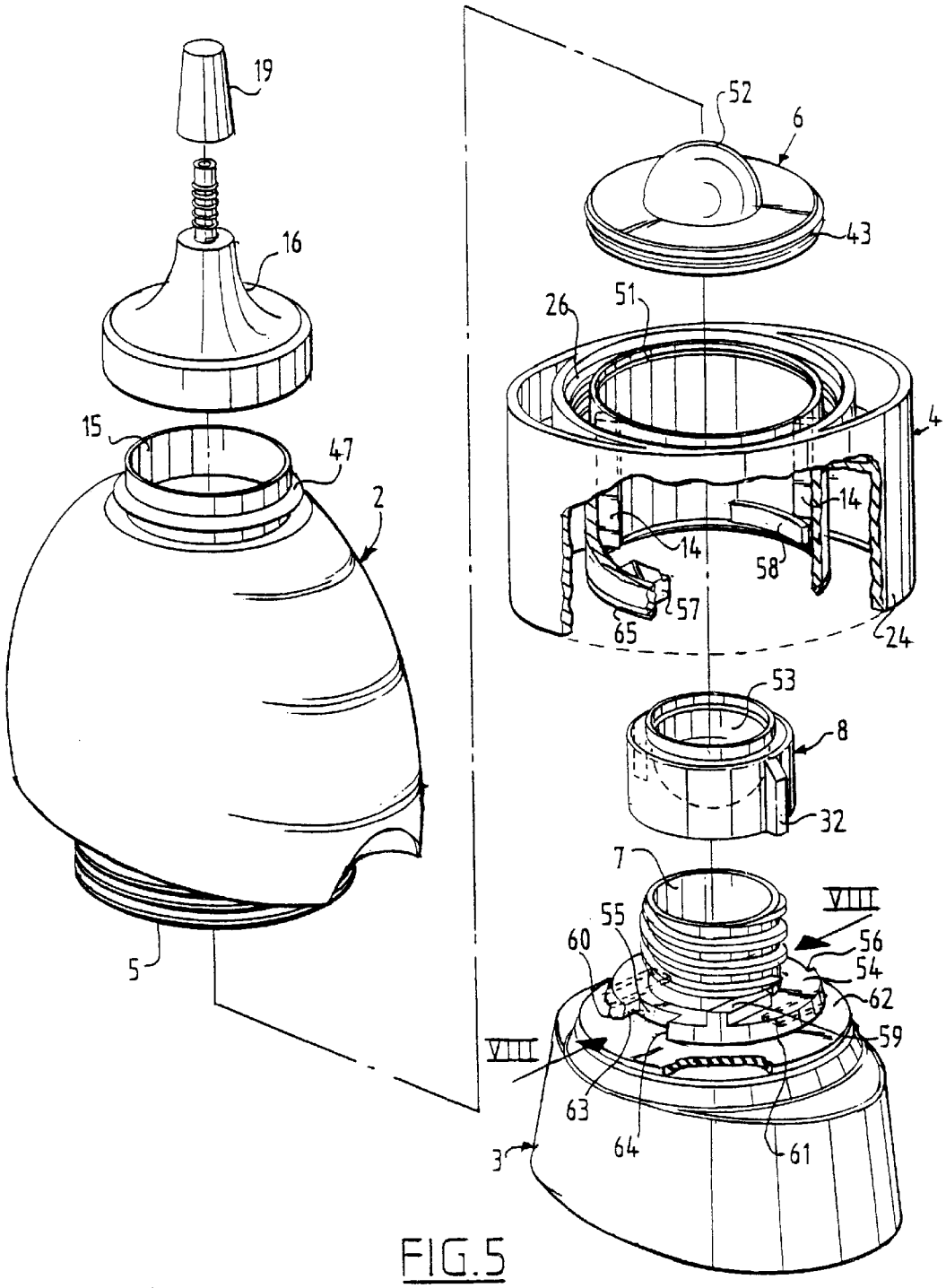

In an alternative embodiment of the container system according to the present invention (FIG. 5) the lower container 3 is connected to the connecting element 4 using a bayonet connection. In this arrangement the lower container 3 is provided with a circumferential rim 54 with two diametrically opposed recesses 55 and 56 whereas the connecting element 4 is provided with two cams 57 and 58 fitting into the recesses and protruding inward from the inside wall of the cylindrical portion 23 of the connecting element 4. The cam 57 and the recess 55 in this arrangement differ in their dimensions from the dimensions of the cam 58 and the recess 56 in such a manner that the connecting element 4 can be mounted to the lower container 3 in only one manner merely. The recesses 55, 56 and the cams 57, 58 are designed in such a manner that the lower container 3 can be rotated in only one direction merely relative to the connecting element 4 after the cams have been inserted into the recesses. In this arrangement each recess 55, 56 on one side presents a surface 63 bevelled towards the lower side which serves as a guide element for the rotatory movement of the lower container 3 relative to the intermediate connecting element 4 whereas the opposite surface 64 of each recess 55, 56 serves as a stop preventing rotation of the lower container 3 in another direction. The recesses 55, 56 as mentioned are arranged diametrically opposed in the rim 54 and in the design example shown are arranged symmetrically with respect to the short symmetry axis of the lower container 3. The cams 57, 58, also arranged diametrically opposite of each other, are arranged at about half way between the short and the long symmetry axis of the connecting element 4 in such a manner that the lower container 3 encloses an angle of about 45 degrees with respect to the connecting element 4 in the position in which the cams 57, 58 can be inserted into the recesses 55, 56. As the lower container 3 and the connecting element are of non-circular cross-section this angle between the two elements is clearly visible and thus is a good indicator showing the actual situation during the assembly of the container system 1.

Around the neck 31 of the lower container 3 a ring-shaped seal made from a spring-elastic deformable material, e.g. from a rubber-type material, is arranged at the lower rim 54. This seal ring in the mounted state of the container system 1 co-operates with the lower rim 65 of the cylindrical portion 23 of the intermediate connecting element 4 in order to prevent leakage of the liquid at the bayonet connection. The lower rim 65 of the cylindrical portion 23 in this arrangement is pressed firmly against the seal ring 62 as the cams 57, 58 during the rotation of the lower container 3 relative to the connecting element 4 are forced under the rim 54.

Figure 6:
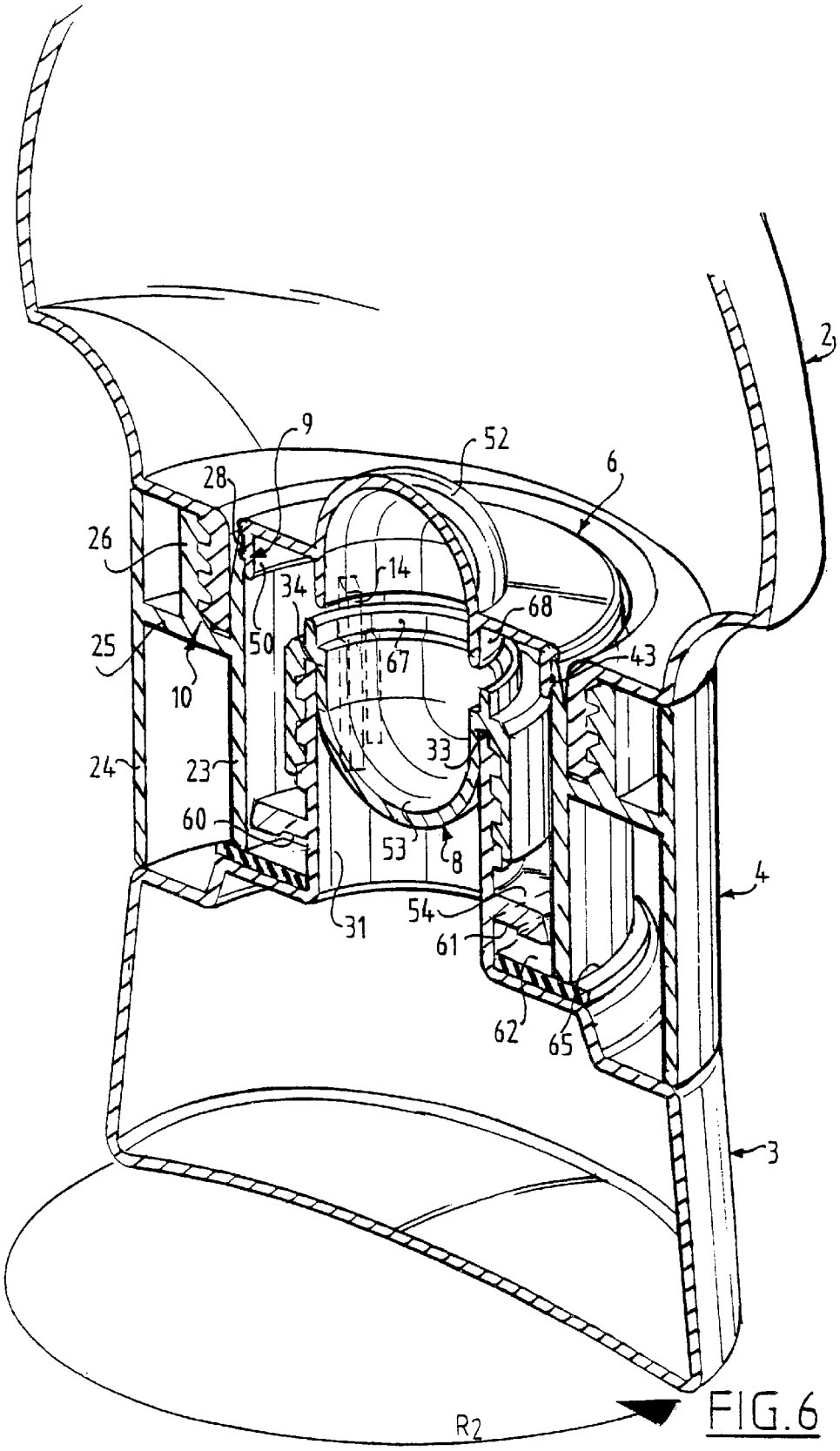
Figure 7:
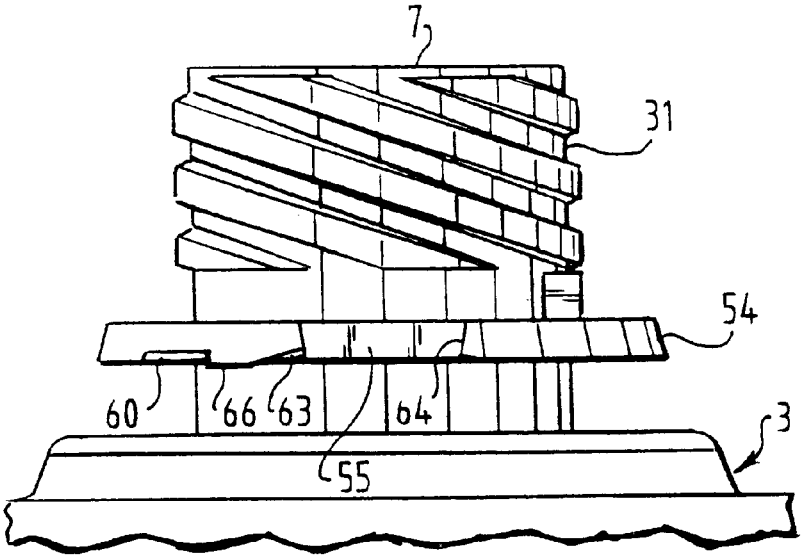
Figure 8:
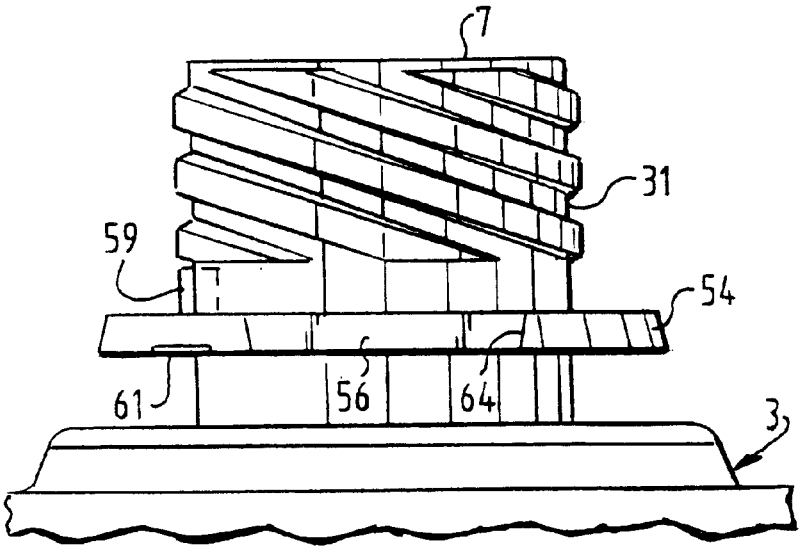

Upon assembling the lower container 3 and the connecting element 4 the lower container 3 can be rotated into a sealed position for use in which arrangement the outer contour of the lower container 3 is arranged adjacent to the one of the intermediate connecting element 4 (FIG. 6). In this position the two elements are blocked against each other as the cams 57, 58 rest in the recesses 60, and 61 respectively, below the rim 64. At least one of these recesses, in the example shown the recess 60, is provided with a rim 66 extending downward (FIG. 7) which serves as a stop and prevents any backward rotation of the lower container 3.

When the contents of the container system 1 is to be made use of the lower container 3 is rotated again relative to the intermediate connecting element 4 (arrow $R_2$ in the FIG. 6), in the case shown over half a turn. In this process the cams 57, 58 are forced down somewhat from the recesses 60, 61 in such a manner that the lower rim 65 of the intermediate connecting element 4 is pressed with additional force against the upper surface of the sealing ring 62 and that a proper sealing effect is ensured also in case the dimensional tolerances of the various elements of the container system 1 have increased over time due to deformations of the materials. At the end point of the half turn rotation the cams 57, 58 are situated in the opposite recesses 60, and 61 respectively, in such a manner that the lower container 3 again is blocked against backward rotation. Owing to the stop rim 59 (FIG. 5) on the upper part of the bayonet rim 54 which co-operates with a longer guide rim 14 of the intermediate connecting element 4 also further rotation of the lower container 3 is prevented. The various elements of the container system 1 thus can not be moved further.

The screw-on cap 8 as well as the snap-on sealing cap 6 in the design example shown differ slightly in their shapes from the ones shown with reference to the first embodiment described. Both sealing caps 6, 8 present a semi-spherical portion 52, and 53 respectively, which together form a liquid-proof sphere after the sealing caps have been brought into contact. For this purpose screw-on cap 8 is provided with a protruding rim 67 which can be snapped onto a rim 68 extending downward from the sealing cap 6 to form a tight connection. The sealing cap 6 for forming a snap-on connection 9 furthermore is provided with a circumferential flange 50 which is inserted into a groove 51 in the inside wall of the cylindrical portion 23 of the intermediate connecting element 4. As the rim 43 and the groove 51 are designed relatively shallow this snap-on connection is disconnected more easily.

Figure 9:
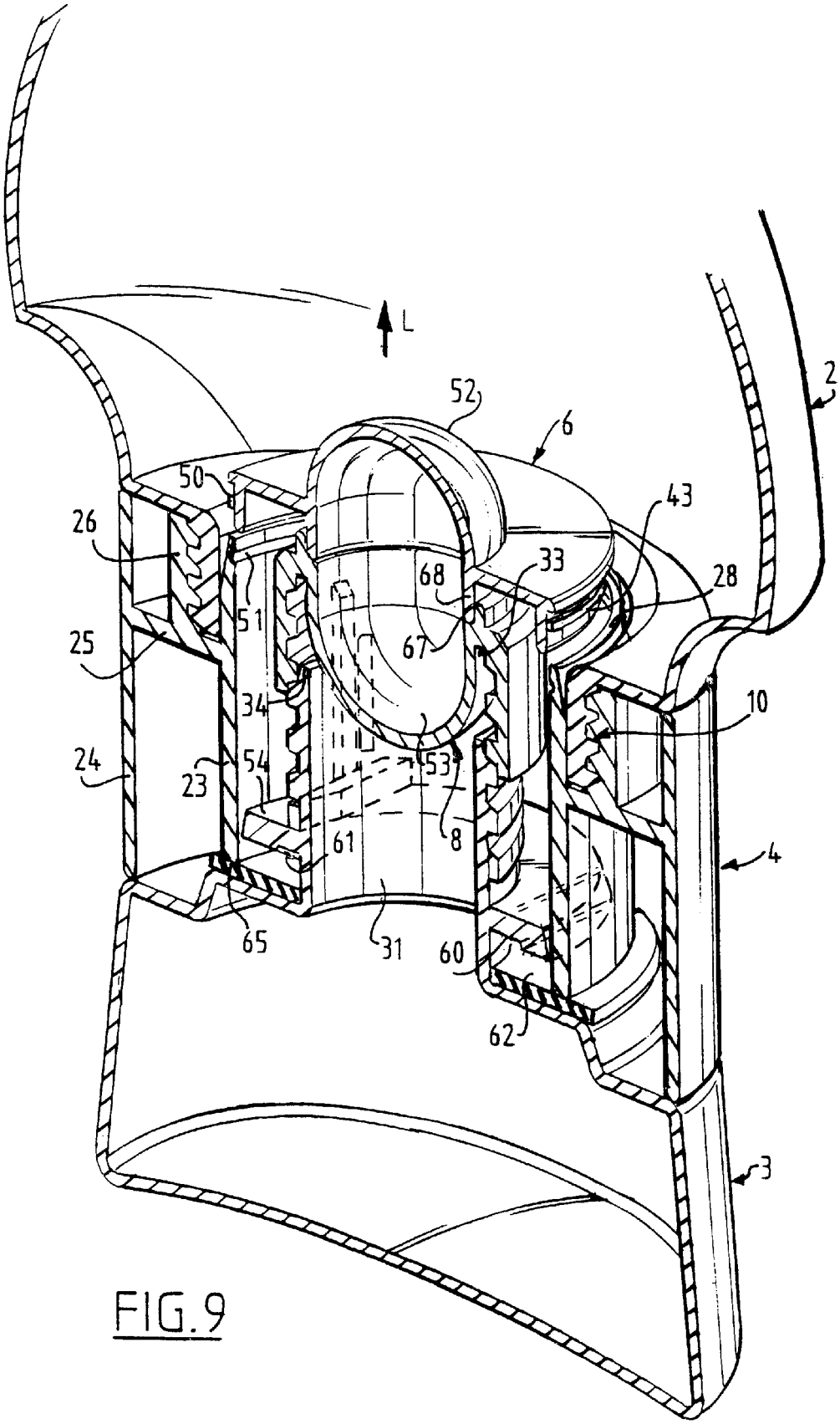

During the rotation of the lower container 3 the screw-on cap 8, in analogy to the arrangement shown in the first embodiment described, is secured against further rotation as the protruding cams 32 engage the rims 24 of the intermediate connecting element 4. Also if the cams 32 at first are not yet resting against the rims 14, this position is reached after a slight further rotation of the screw-on cap 8 i.e. the rims 14 exert a self-centring effect. The screw-on cap 8 thus is moved upward towards the neck 31 of the lower container 3. In this process this cap will contact the sealing cap 6 of the upper container 2 and thus form a liquid-proof connection the rims 67, 68 being mutually clamped FIG. 9). As the spherical room between the two sealing caps 6, 8 is filled with air the sealing caps 6, 8 forming a sphere together are lifted upward from the opening of the intermediate connecting element 4 into the upper container 2. Owing to the lift of these sealing caps 6, 8 they can be disconnected more easily. The sealing caps 6, 8 floating in the upper container 2 furthermore serve as an excellent shaker element in such a manner that blending of the mixed liquid components is improved.

As in the container system 1 according to the present invention many different snap-on connections can be used the individual elements can be easily manufactured and assembled. Furthermore the containers 2, 3 do not require an axial movement relative to each other, which is necessitated in the above mentioned German patent application 19635833, and that thus also no blocking devices in the form of tear-off strips are required in order to mutually fix the two containers 2, 3 in their initial positions. All elements of the container system 1 thus in principle can be re-filled and can be re-used less waste being generated in this manner.

What is claimed is:

1. A dual component container system adapted for mixing separately stored substances, comprising at least two containers, wherein a first container is provided with a first mixing opening, which is adapted to be sealed with a first sealing member, and a second container having a second mixing opening, which is adapted to be sealed with a second sealing member, and further comprising a hollow connecting element interposed between said first and second containers which cooperates with said first and second sealing members for opening a conduit between said containers, wherein at least one of said sealing members is connected to the connecting element by a releasable clamping joint, and said connecting element being connected to said first and second containers such that first and second sealing members will be removed from the connecting element by a relative rotation between said containers.

2. A dual component container system according to claim 1, wherein said sealing members are connected to the connecting element by a snap-fit connection.

3. A dual component container system according to claim 2, wherein at least one of said containers is connected in an axial direction essentially immovable relative to said connecting element.

4. A dual component container system according to claim 3, wherein said essentially immovable connected container is connected to the connecting element by a clamping or snap-fit joint.

5. A dual component container system according to claim 3, wherein said essentially immovable connected container is connected to the connecting element by a bayonet joint.

6. A dual component container system according to claim 1, wherein the second sealing member is connected to the second container by a screw joint thus forming a screw joint sealing member, and the connecting element further comprises a means for securing said sealing member against rotation relative to said connecting element.

7. A dual component container system according to claim 6, wherein the securing means comprises at least one protruding guide rim provided between the sealing members and cooperating with the screw joint sealing member.

8. A dual component container system according to claim 7, wherein the guide rim is designed as a self-centering rim.

9. A dual component container system according to claim 6, wherein said second container which is sealed by the screw joint sealing member, and said connecting element are provided with a non-circular cross-section design.

10. A dual component container system according to claim 9, wherein said second container and said connecting element are provided with a locking means which cooperate and act in a predetermined direction of rotation.

11. A dual component container system according to claim 10, wherein said second container and said connecting element are designed for being rotatable relative to each other over at least half a revolution.

12. A dual component container system according to claim 1, wherein at least one seal is provided between said containers.

13. A dual component container system according to claim 1, wherein said sealing members are designed to form a leak-proof unit.

14. A dual component container system according claim 1, wherein at least one of said containers further comprises a dispenser opening which is closable by a clamping cap.

* * * * *